US008326608B2

(12) United States Patent
Hu et al.

(10) Patent No.: US 8,326,608 B2
(45) Date of Patent: Dec. 4, 2012

(54) TRANSCODING METHOD, APPARATUS, DEVICE AND SYSTEM

(75) Inventors: Chen Hu, Shenzhen (CN); Lei Miao, Beijing (CN); Zexin Liu, Beijing (CN); Longyin Chen, Shenzhen (CN); Herve Marcel Taddei, Voorburg (NL); Qing Zhang, Shenzheng (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/359,339

(22) Filed: Jan. 26, 2012

(65) Prior Publication Data

US 2012/0136669 A1 May 31, 2012

Related U.S. Application Data

(63) Continuation of application No. PCT/CN2010/075497, filed on Jul. 28, 2010.

(30) Foreign Application Priority Data

Jul. 31, 2009 (CN) ..... 2009 1 0109510

(51) Int. Cl.
*G10L 21/00* (2006.01)

(52) U.S. Cl. ..... 704/201; 704/200; 704/500; 704/501; 704/502; 704/503

(58) Field of Classification Search ..... 704/200–230, 704/500–504
See application file for complete search history.

(56) References Cited

U.S. PATENT DOCUMENTS

| | | | | |
|---|---|---|---|---|
| 2004/0049376 | A1* | 3/2004 | Sperschneider et al. | 704/200.1 |
| 2004/0153316 | A1 | 8/2004 | Hardwick | |
| 2005/0015243 | A1 | 1/2005 | Lee et al. | |
| 2006/0154679 | A1 | 7/2006 | Chang | |
| 2008/0260048 | A1* | 10/2008 | Oomen et al. | 375/241 |
| 2009/0012784 | A1 | 1/2009 | Murgia et al. | |
| 2009/0030677 | A1* | 1/2009 | Yoshida | 704/219 |
| 2009/0276210 | A1* | 11/2009 | Goto et al. | 704/211 |
| 2009/0326931 | A1* | 12/2009 | Ragot et al. | 704/220 |
| 2010/0017200 | A1* | 1/2010 | Oshikiri et al. | 704/207 |

FOREIGN PATENT DOCUMENTS

| | | | |
|---|---|---|---|
| CN | 1585970 | A | 2/2005 |
| CN | 1784716 | A | 6/2006 |
| CN | 1918634 | A | 2/2007 |
| JP | 4031149 | A | 2/1992 |

(Continued)

OTHER PUBLICATIONS

Written Opinion of the International Searching Authority dated Nov. 4, 2010 in connection with International Patent Application No. PCT/CN2010/075497.

(Continued)

*Primary Examiner* — Douglas Godbold

(57) ABSTRACT

A method, a device, and a system for transcoding between two embedded codecs are disclosed. The method includes: delaying a first encoded stream in input streams for integer number of frames, where the first encoded stream includes a stream of at least one extension layer in the input streams obtained after input signals are encoded by using a first codec; and using the first codec to decode other encoded streams in the input streams to obtain the first decoded signal; and performing delay aligning and adjusting to obtain an adjusted signal so as to reduce the transcoding complexity and enhance quality of the transcoded signals.

11 Claims, 10 Drawing Sheets

FOREIGN PATENT DOCUMENTS

| | | | |
|---|---|---|---|
| JP | 10-327074 | | 12/1998 |
| JP | 2000341691 | A | 12/2000 |
| JP | 2007524124 | A | 8/2007 |
| WO | WO 02/080147 | A1 | 10/2002 |
| WO | WO 03/081196 | A1 | 10/2003 |
| WO | WO 2006/120931 | A1 | 11/2006 |
| WO | WO 2008/034723 | A1 | 3/2008 |
| WO | WO 2009/008947 | A1 | 1/2009 |

OTHER PUBLICATIONS

International Search Report dated Nov. 4, 2010 in connection with International Patent Application No. PCT/CN2010/075497.

Notice of Reasons for Rejection dated Jun. 26, 2012 in connection with Japanese Patent Application No. 2012-521949.

* cited by examiner

TRANSCODING METHOD, APPARATUS, DEVICE AND SYSTEM

CROSS-REFERENCE TO RELATED APPLICATIONS

This application is a continuation of International Application No. PCT/CN2010/075497, filed on Jul. 28, 2010 which claims priority to Chinese Patent Application No. 200910109510.1, filed with the Chinese Patent Office on Jul. 31, 2009, both of which are hereby incorporated by reference in their entireties.

TECHNICAL FIELD

The present application relates to a technology of transcoding a signal stream, and in particular, to a transcoding method, apparatus, device, and system.

BACKGROUND

With increase of network bandwidth, the network transmission rate becomes higher and higher, and people's requirements on voice quality in communication become higher and higher. To meet people's requirements on voice quality, more and more embedded voice codecs are developed. An embedded voice codec is a codec formed by a core layer and several extension layers. The core layer is generally a conventional narrowband or wideband codec, and the extension layers may be wideband, super wideband or even full-band extensions, or may be stereo multi-channel extensions. The embedded voice codec is compatible with a conventional codec, and provides more extension functions as required.

To enable communication between different embedded codecs, transcoding is required, namely, decoding and then coding. The conventional transcoding method generally is: decoding an encoded stream that passes through a first encoder, and then encoding the stream by using a second encoder ready for transcoding. As shown in FIG. 1, at the time of transcoding, a core-layer stream encoded by the first encoder and all received extension-layer streams are decoded, and are then encoded again by the second encoder ready for transcoding. The encoding and decoding method and bandwidth used at part even all of the extension layers before the transcoding are consistent with those after the transcoding.

In the case that the encoding method and the encoding bandwidth for part even all of the extension layers before the transcoding are consistent with those after the transcoding, the use of the transcoding method in the prior art will definitely increase complexity of encoding and decoding and impairs signal quality.

SUMMARY

An embodiment of the present application provides a transcoding method, apparatus, device and system to reduce complexity of encoding and decoding in a transcoding process and enhance signal quality.

To fulfill the foregoing objectives, an embodiment of the present application provides an encoding method, including:

delaying a first encoded stream in input streams for an integer number of frames, where the first encoded stream includes a stream of at least one extension layer in the input streams obtained after input signals are encoded by using a first codec; and performing delay aligning and adjusting on a first decoded signal to obtain an adjusted signal, where the first decoded signal is obtained by the first codec decoding other encoded streams in the input streams, the other encoded streams include streams of other layers in the input streams obtained after the input signals are encoded by using the first codec, and the streams of other layers include a core-layer stream and exclude the first encoded stream.

Another embodiment of the present application provides a transcoding method, including:

delaying a first encoded stream in input streams for an integer number of frames, where the first encoded stream includes a stream of at least one extension layer in the input streams obtained after input signals are encoded by using a first codec;

using the first codec to decode other encoded streams in the input streams to obtain a first decoded signal, where the other encoded streams include streams of other layers in the input streams obtained after the input signals are encoded by using the first codec, and the streams of other layers include a core-layer stream and exclude the first encoded stream;

performing delay aligning and adjusting on the first decoded signal to obtain an adjusted signal;

using a second codec to encode the adjusted signal to obtain a second encoded stream; and multiplexing and outputting the second encoded stream and the first encoded stream that is delayed for the integer number of frames.

Another embodiment of the present application provides a transcoding apparatus, including:

an integer-number frame delaying module, configured to delay a first encoded stream in input streams for an integer number of frames, where the first encoded stream includes a stream of at least one extension layer in the input streams obtained after input signals are encoded by using a first codec; and a delay aligning module, configured to perform delay aligning and adjusting on a first decoded signal to obtain an adjusted signal, where the first decoded signal is obtained by the first codec decoding other encoded streams in the input streams, the other encoded streams include streams of other layers in the input streams after the input signals are encoded by using the first codec, and the streams of other layers include a core-layer stream and exclude the first encoded stream.

Another embodiment of the present application provides a transcoding device, including:

a receiving module, configured to receive a first encoded stream in input streams and a first decoded signal which is obtained by the first codec decoding other encoded streams in the input streams except the first encoded stream, where the first encoded stream includes a stream of at least one extension layer in the input streams obtained after the input signals are encoded by using the first codec;

an integer-number-frame delaying module, configured to delay the first encoded stream for an integer number of frames;

a delay aligning module, configured to perform aligning and adjusting on the first decoded signal to obtain an adjusted signal, where the other encoded streams include streams of other layers in the input streams after the input signals are encoded by using the first codec, and the streams of other layers include a core-layer stream and exclude the first encoded stream; and an outputting apparatus, configured to output to a second codec the adjusted signal and the first encoded stream that is delayed for the integer number of frames.

Another embodiment of the present application provides a transcoding system, including:

a first codec, configured to decode other encoded streams to obtain a first decoded signal, where the other encoded streams include streams of other layers in input streams obtained after input signals is decoded by using the first codec, and the streams of other layers include a core-layer stream and exclude a first encoded stream;

a transcoding apparatus, configured to delay the first encoded stream for an integer number of frames, and perform delay aligning and adjusting on the first decoded signal to obtain an adjusted signal; and a second codec, configured to encode the adjusted signal to obtain a second encoded stream, and multiplex the second encoded stream and the first encoded stream that is delayed for the integer number of frames.

Another embodiment of the present application provides a mobile station of the foregoing transcoding apparatus.

Another embodiment of the present application provides a network element of the foregoing transcoding apparatus.

Therefore, through introduction of the transcoding method, apparatus, device, and system provided in an embodiment of the present application, only a part of streams need to be encoded and decoded again, the transcoding complexity of the embedded codec is reduced significantly; and in the same way, because a part of streams is decoded or encoded, the quality of signals being transcoded is enhanced effectively.

BRIEF DESCRIPTION OF THE DRAWINGS

To make the technical solution of the present application or the prior art clearer, accompanying drawings to be used for the description of the embodiments of the present application or the prior art are briefly introduced in the following. Apparently, the accompanying drawings described below are only some of the embodiments of the present application, and persons of ordinary skill in the art can derive other drawings from these drawings without any creative effort.

DETAILED DESCRIPTION

The technical solutions in the embodiments of the present application are described clearly and completely in the following with reference to the accompany drawings in the present application. Evidently, the embodiments to be described are only some rather than all of the embodiments of the present application. All other embodiments, which are derived by those skilled in the art based on the embodiments in the present application without any creative effort, shall fall within the protection scope of the present application.

Embodiment 1

Figure 1:
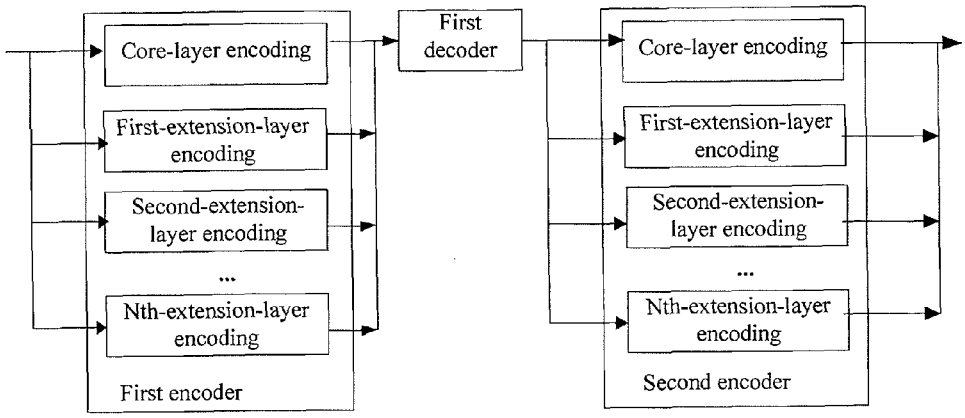
FIG. 1 is a schematic diagram of transcoding in the prior art.
Figure 2:
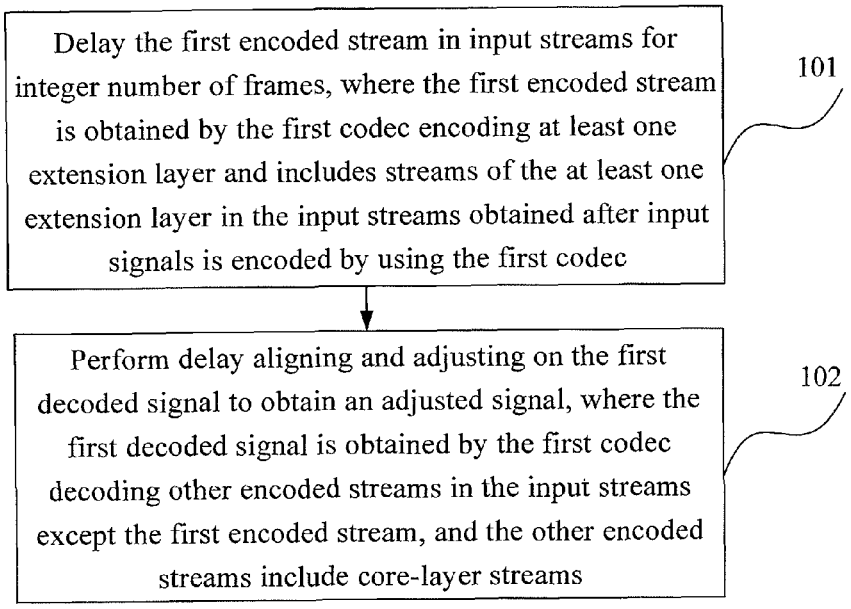
FIG. 2 is a schematic diagram of a transcoding method embodiment according to the present application.

An embodiment of the present application provides a method for transcoding between two embedded codecs. As shown in FIG. 2, the method includes the following steps:

S101: Delay a first encoded stream in input streams for an integer number of frames, where the first encoded stream includes a stream of at least one extension layer in the input streams obtained after input signals are encoded by using a first codec.

The encoding method and bandwidth used by the first codec for the at least one extension layer are the same as those used by the second codec for the at least one extension layer.

S102. Perform delay aligning and adjusting on a first decoded signal to obtain an adjusted signal, where the first decoded signal is obtained by the first codec decoding other encoded streams in the input streams, the other encoded streams include streams of other layers in the input streams after the input signals are encoded by using the first codec, and the streams of other layers include a core-layer stream and exclude the first encoded stream.

The relationship between the delay of the second encoded stream obtained by the second codec encoding the adjusted signal and the delay of the first encoded stream delayed for the integer number of frames corresponds to the relationship between the encoding delay of the second codec encoding the at least one extension layer and the encoding delay of encoding at other layers.

The first codec and the second codec may be a physically integrated codec entirety, or physically separated entities, that is, the first codec includes a first encoder and a first decoder which are respectively used for encoding a stream and for decoding a stream.

In the transcoding method according to the embodiment of the present application, only a part of streams are encoded and decoded again; the streams which are not decoded or encoded any more undergo delay aligning and adjusting, and the part of streams decoded and encoded again are delayed for the integer number of frames. In this way, the transcoding complexity of the embedded codec may be reduced significantly, and the quality of signals being transcoded is enhanced effectively because apart of streams are not encoded or decoded again.

Embodiment 2

Figure 3:
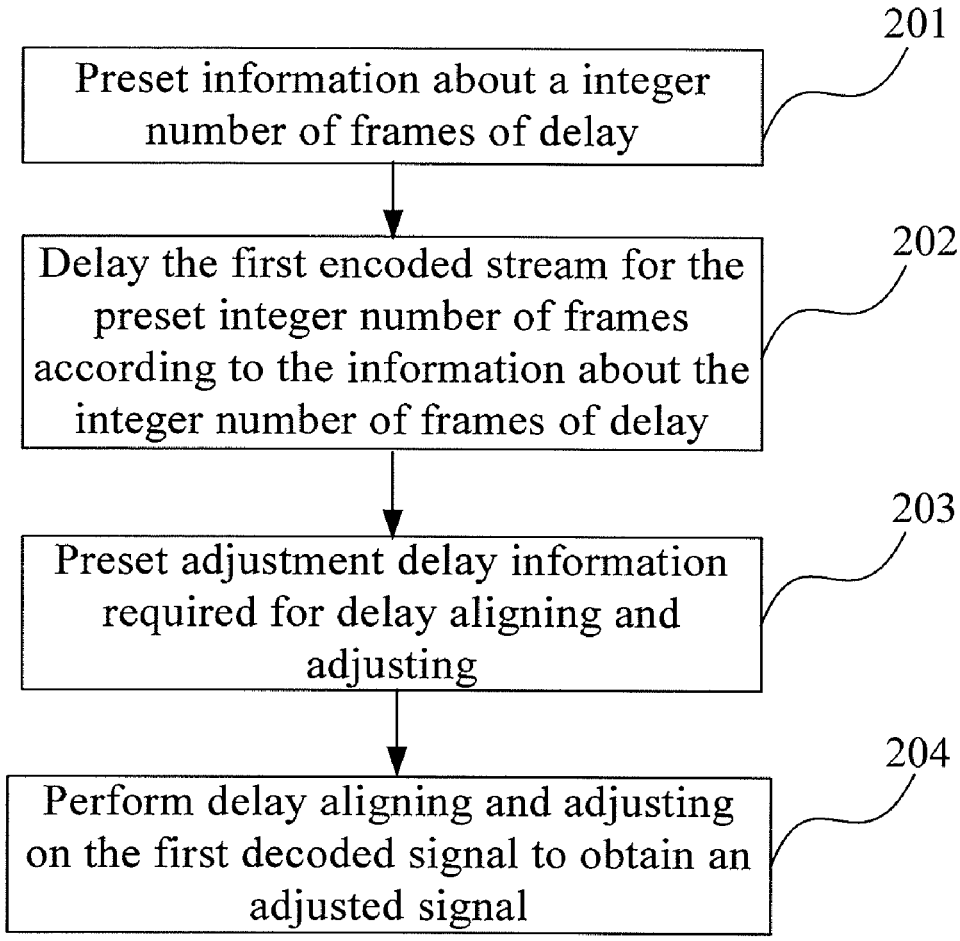
FIG. 3 is a schematic diagram of another transcoding method embodiment according to the present application.

Another embodiment of the present application provides a method for transcoding between two embedded codecs. As shown in FIG. 3, the method includes:

S201: Preset information about the integer number of frames of delay.

The presetting the information about the integer number of frames of delay may include: presetting the number of the integer number of frames of delay or length of the integer number of frames of delay. The information about the integer number of frames of delay is set in a module loading manner or in a system presetting manner. The number of the integer number of frames of delay or length of the integer number of frames of delay is determined, according to the length of the signal frames and in combination with the delays of the encoded streams and decoded streams of the first codec and the second codec, and may be represented by a function related to the length of the signal frames and to the delays of the encoded streams and decoded streams of the first codec and the second codec.

S202. Delay the first encoded stream for the integer number of preset frames according to the information about the integer number of frames of delay.

The first encoded stream is obtained by the first codec encoding at least one extension layer; and the method and the bandwidth for using the first codec for encoding at the at least one extension layer are consistent with those for using the second codec, which are required for transcoding, for encoding at the at least one extension layer. Because the encoding method used by the codec at the at least one extension layer before the transcoding is the same as that after the transcoding, decoding and encoding again will cause unnecessary operations, and drastically increase complexity of transcoding. In this embodiment, for the at least one extension layer, the first encoded stream encoded by the first codec is delayed for the integer number of preset frames according to the preset information about the integer number of frames of delay, and therefore, the processing is not performed for bit information in the stream, but the stream as a whole is delayed for a length of a transmission frame.

S203: Preset adjustment delay information required for delay aligning and adjusting.

The presetting adjustment delay information may include presetting time of an adjustment delay or duration of the adjustment delay. The adjustment delay information is set in a module loading manner or in a system presetting manner. The preset duration of the adjustment delay is determined according to the length of the signal frame, in combination with the delays of encoded streams and decoded streams of the first codec and the second codec, and the integer number of frames of delaying the first encoded stream.

It should be noted that this step may be performed immediately after step S201.

S204. Perform delay aligning and adjusting on the first decoded signal to obtain an adjusted signal.

The first decoded signal is obtained by the first codec decoding other encoded streams which include a core-layer encoded stream and exclude the first encoded stream, where the other encoded streams are obtained by using the first codec for encoding at other layers excluding the at least one extension layer. The relationship between the delay of the second encoded stream obtained by the second codec encoding the adjusted signal and the delay of the first encoded stream delayed for the integer number of frames corresponds to the relationship between the encoding delay of the second codec encoding the at least one extension layer and the encoding delay of encoding at other layers. Encoding and decoding is not repeated at the at least one extension layer, but the first encoded stream encoded by the first codec is multiplexed directly. Therefore, the first time point of other encoded streams needs to be aligned with the second time point of the at least one extension layer. Through S202 and the adjustment of the first time point and the second time point in this step, it is ensured that: The delay relationship between streams multiplexed and output for the second-time decoding corresponds to the delay relationship between the stream obtained by the second codec encoding at only at least one extension layer and the stream obtained by the second codec encoding at the other layers excluding the at least one extension layer.

In the transcoding method in this embodiment, only a part of streams are encoded and decoded again; the streams which are not decoded or encoded any more undergo delay aligning and adjusting, and the part of streams decoded and encoded again are delayed for the integer number of frames. In this way, the transcoding complexity of the embedded codec may be reduced significantly, and the quality of signals being transcoded is enhanced effectively because a part of streams are not encoded or decoded any more. For the transcoding between most embedded codecs, this embodiment reduces extra delay generated in the transcoding, for example, generates no extra delay at the time of transcoding.

Embodiment 3

Figure 4:
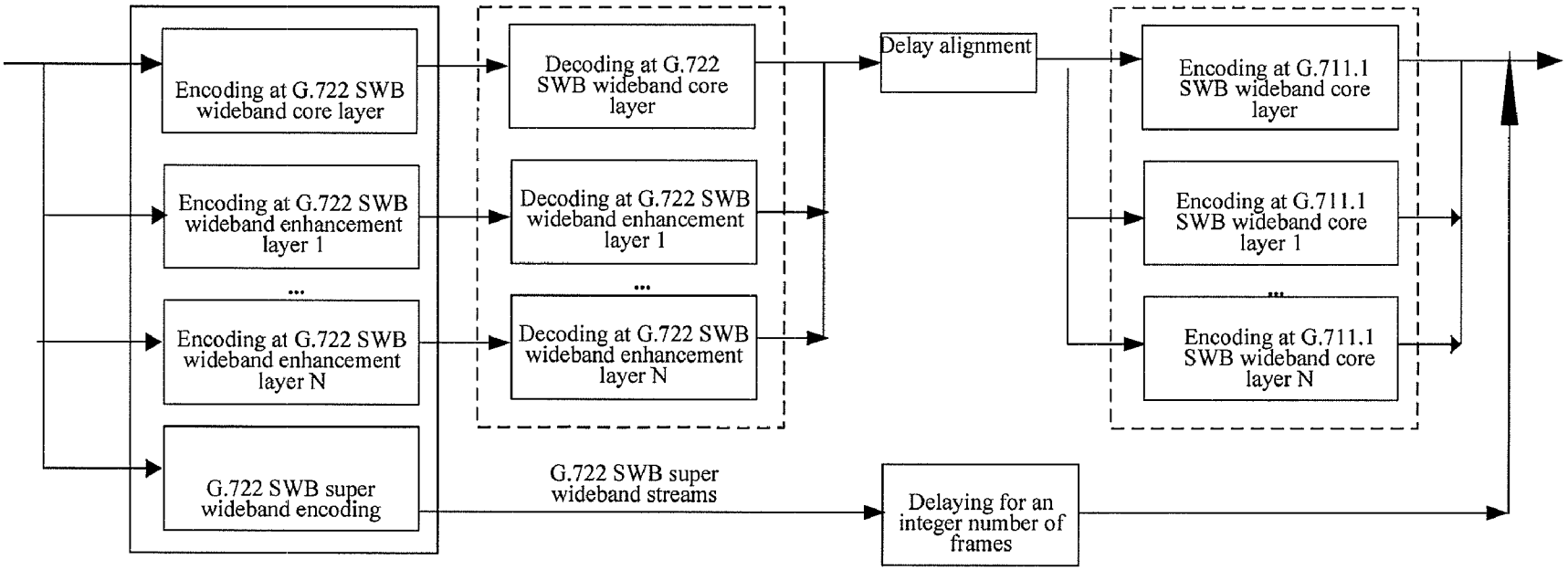
FIG. 4 is a schematic diagram of another transcoding method embodiment according to the present application.

A more detailed embodiment of the present application provides a method for transcoding between two embedded codecs. As shown in FIG. 4:

In this embodiment, a G.722 super wideband extension codec is used as a first codec, and a G.711.1 super wideband codec is used as a second codec, at least one extension layer requiring no more decoding or encoding are marked as Mlayer, which are super wideband encoding layers in FIG. 4, and the streams encoded by the first codec on Mlayer are multiplexed directly; other layers which include a core layer and exclude the Mlayer are marked as Nlayer, and the Nlayer needs to be encoded by the first encoder and then decoded, and then encoded by the second encoder. In the embodiment of the present application, the time point of the Nlayer encoded again needs to be aligned with the time point of the directly multiplexed Mlayer, and therefore, in the transcoding process, the delay of the Mlayer need to be aligned, and the Nlayer need to be delayed for the integer number of frames.

The first encoder applies a delay of e11 to the Nlayer, and applies a delay of e12 to the Mlayer; the first decoder applies a delay of d11 to the Nlayer, and applies a delay of d12 to the Mlayer; the second encoder applies a delay of e21 to the Nlayer, and applies a delay of e22 to the Mlayer; and the second decoder applies a delay of d21 to the Nlayer, and applies a delay of d22 to the Mlayer; and the length of the signal frame is T_frame. The delay of the Nlayer are aligned and adjusted, with the adjustment length being D; and the adjustment length includes a calculation relationship between the integer number of frames related to the frame length and a sum of differences between delays of encoded streams and decoded streams of the first codec and the second codec. The streams of the Mlayer are delayed for L frames, where L is an integer number, and values of L include a value determined by a ratio function of the frame length to the sum of differences between delays of encoded streams and decoded streams of the first codec and the second codec. In an implementation mode, L and D may be expressed as:

$$L=\text{ceil}((e11+d11+e21+d21-e12-d22)/T_\text{frame})$$

$$D=L*T_\text{frame}-(e11+d11+e21+d21-e12-d22)$$

As above, the integer number of frames of delay and the length of delay aligning and adjusting relate to the delays applied by the first encoder to the Nlayer and Mlayer, the delay applied by the first decoder to the Nlayer, the delay applied by the second encoder to the Nlayer, and the delays applied by the second decoder to the Nlayer and Mlayer. The delays above may be a zero value, that is, no delay exists, or other values.

First, the received G.722SWB wideband core-layer streams and streams of N1 wideband enhancement layers, that is, streams of the Nlayer are decoded to obtain decoded signals of the Nlayer. Afterward, according to the values of L and D, the delays of the decoded signals of the Nlayer are aligned, and the delays of the G.722SWB super wideband streams, which are streams of the Mlayer, are adjusted for integer number of frames. For example, in this embodiment:

$$e11+d11=e12+d22=6.375 \text{ ms}$$

$$e21+d21=6.875 \text{ ms}$$

$$T_frame=5 \text{ ms}$$

$$L=\text{ceil}((e11+d11+e21+d21-e12-d22)/T_frame)=2 \text{ frames}$$

$$D=L*T_frame-(e11+d11+e21+d21-e12-d22)=3.125 \text{ ms}$$

That is, the decoded signals of the Nlayer are delayed for 3.125 ms, and the streams of the Mlayer are delayed for 2 frames.

This implementation manner is also applicable to other embedded codecs. For example, the first codec is a G.711.1 super wideband extension codec, and the second codec is a G.722 super wideband extension codec.

Embodiment 4

Figure 5:
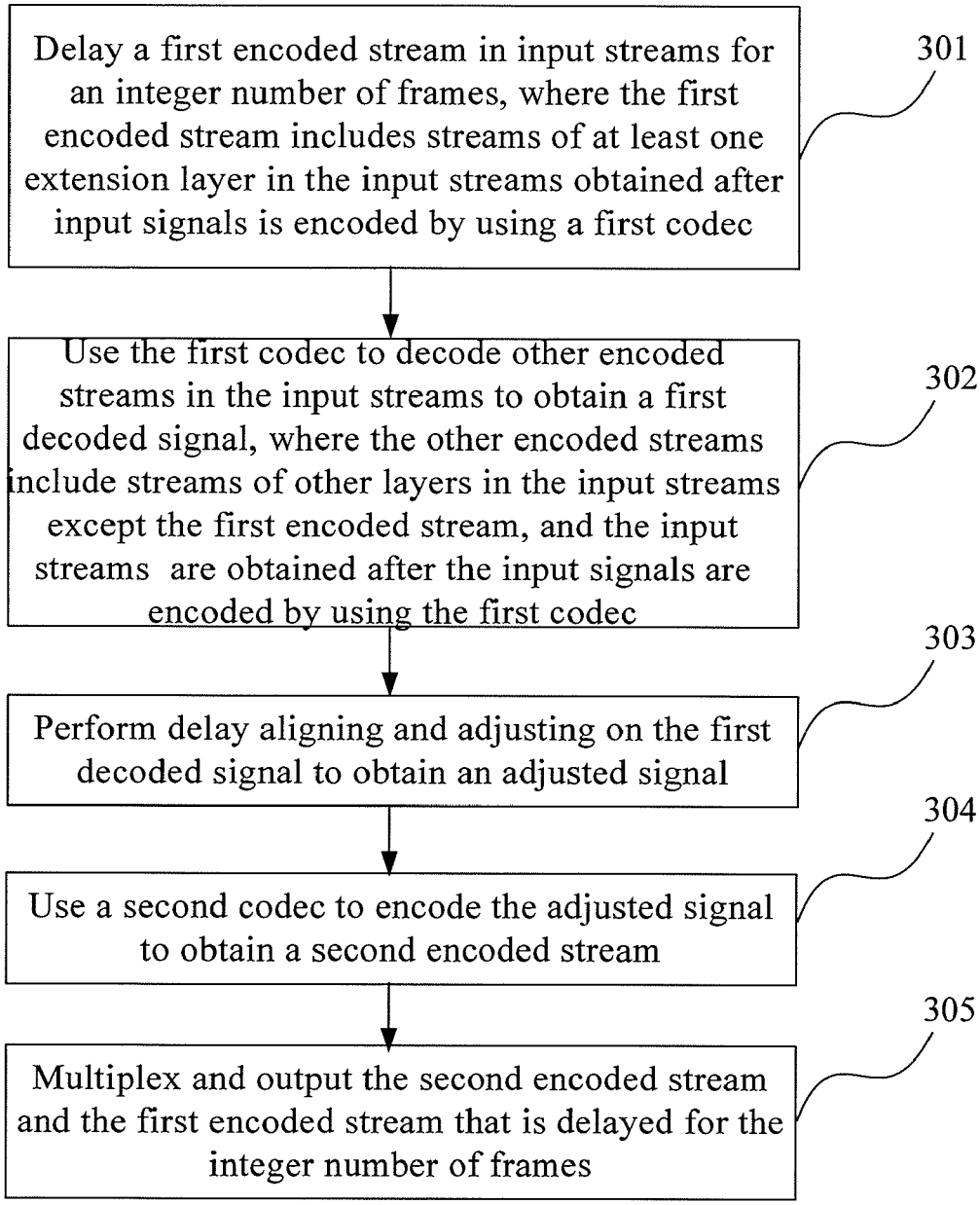
FIG. 5 is a schematic diagram of another transcoding method embodiment according to the present application.

Another embodiment of the present application provides a method for transcoding between two embedded codecs. As shown in FIG. 5, the method includes the following steps:

S301: Delay a first encoded stream in input streams for an integer number of frames, where the first encoded stream includes a stream of at least one extension layer in the input streams obtained after input signals are encoded by using a first codec.

S302: Use the first codec to decode other encoded streams in the input streams to obtain a first decoded signal, where the other encoded streams include streams of other layers in the input streams after the input signals are encoded by using the first codec, and the streams of other layers include a core-layer stream and exclude the first encoded stream.

S303: Perform delay aligning and adjusting on the first decoded signal to obtain an adjusted signal.

S304: Use a second codec to encode the adjusted signal to obtain a second encoded stream.

S305: Multiplex and output the second encoded stream and the first encoded stream that is delayed for the integer number of frames.

In the transcoding method in this embodiment, only a part of streams are encoded and decoded again; the streams which are not decoded or encoded any more undergo delay aligning and adjusting, and the part of streams decoded and encoded again are delayed for the integer number of frames. In this way, the transcoding complexity of the embedded codec may be reduced significantly, the effect of encoding and decoding signals is further improved, and the quality of signals being transcoded, encoded and decoded is enhanced effectively because a part of streams are not encoded or decoded any more. For the transcoding between most embedded codecs, extra delay generated by the transcoding may be reduced, for example, no extra delay at the time of transcoding may be generated.

Embodiment 5

Figure 6:
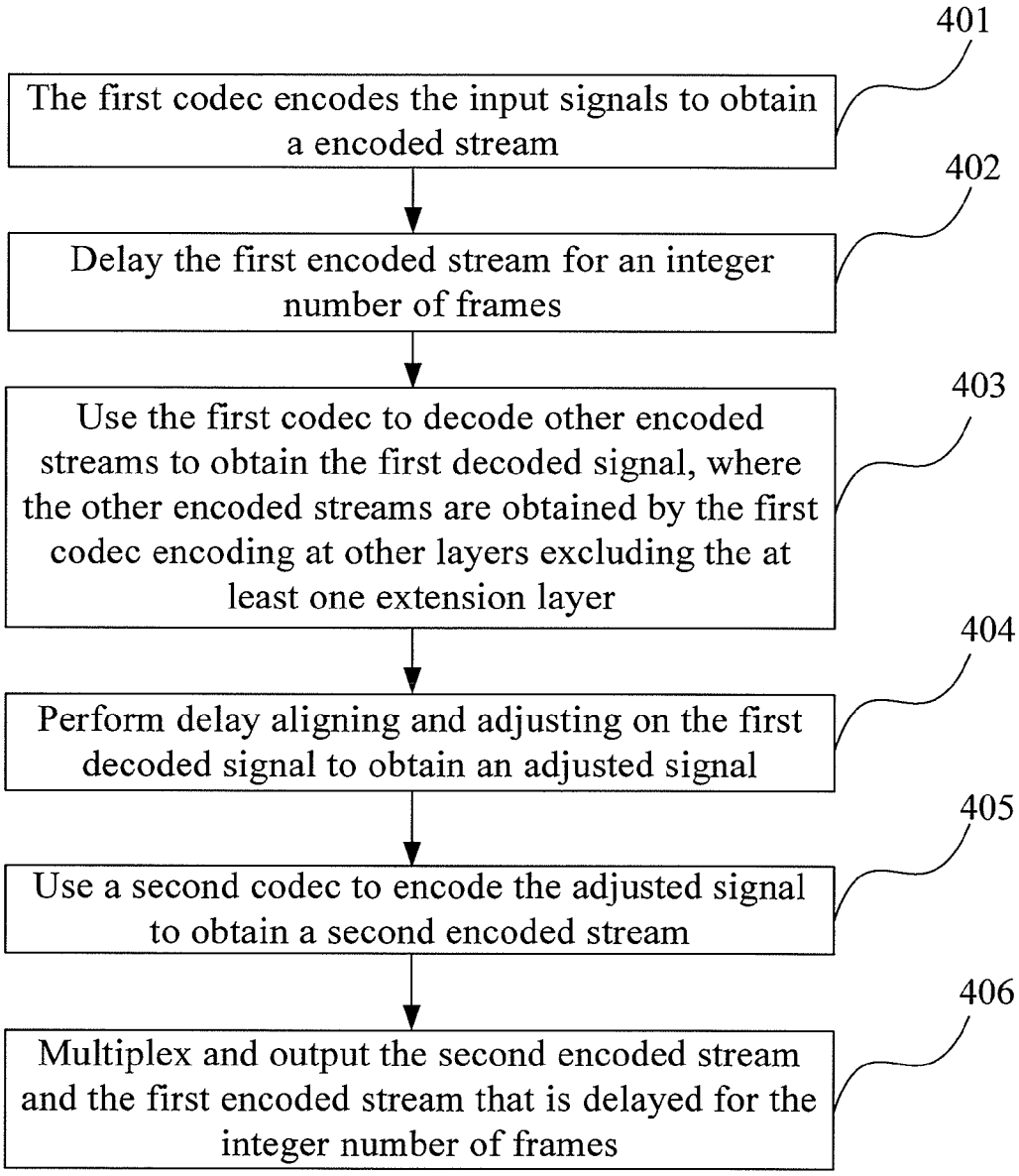
FIG. 6 is a schematic diagram of another transcoding method embodiment according to the present application.

Another embodiment of the present application provides a method for transcoding between two embedded codecs, as shown in FIG. 6.

Before the method is implemented, step S401 is included: The first codec encodes the input signals to obtain encoded streams.

The first codec is the encoder used for the first encoding before transcoding; the first codec is an embedded codec, and the input signals for encoding include extension-layer signals and a core-layer signal; the first encoder encodes the input signals to generate encoded streams; the stream generated through encoding at at least one extension layer is called a first encoded stream; and the method and the bandwidth for the encoder encoding at the at least one extension layer before the transcoding are the same as those after the transcoding of the at least one extension layer. That is, the method and the bandwidth for the first codec encoding at the at least one extension layer are the same as the method and the bandwidth for the second codec encoding at the at least one extension layer. The stream generated by encoding at other layers excluding the at least one extension layer is called other encoded streams, which include a core-layer encoded stream.

S402: Delay the first encoded stream for the integer number of frames.

Because the method for the encoder encoding at the at least one extension layer before the transcoding is the same as that after the transcoding of the at least one extension layer, decoding and encoding the at least one extension layer again which cause unnecessary operations, and increase complexity of the transcoding drastically. However, without proper operations, the delay at the time of multiplexing the first encoded stream does not match with the delay relationship at the time of multiplexing the streams generated by the second encoder encoding at the at least one extension layer. For the at least one extension layer, in the embodiment of the present application, the first encoded stream encoded by the first codec is delayed for the integer number of preset frames according to the preset information about the integer number of frames of delay, and in this case, processing is not performed for bit information in the stream, but the stream as a whole is delayed for a length of a transmission frame.

The presetting the information about the integer number of frames of delay may include: presetting the number of the integer number of frames of delay or the length of the integer number of frames of delay. The information about the integer number of frames of delay is set in a module loading manner or a system presetting manner. The number of frames of delay or length of the integer number of frames of delay is determined according to the length of the signal frames, in combination with the delays of the encoded streams and decoded streams of the first codec and the second codec, and may be represented by a function related to the length of the signal frames and to the delay of the encoded streams and decoded streams of the first codec and the second codec.

The first encoded stream is delayed for the integer number of preset frames according to the information about the integer number of frames of delay. The first encoded stream is obtained by the first codec encoding at least one extension layer; and the method and the bandwidth for using the first codec for encoding at the at least one extension layer are consistent with the method and the bandwidth for using the second codec, which is required for the transcoding, for encoding at the at least one extension layer. Because the method for the codec encoding at the at least one extension layer before the transcoding of the at least one extension layer is the same as that after the transcoding, decoding and encoding the at least one extension layer again will cause unnecessary operations, and increase complexity of transcoding drastically. In this embodiment, for the at least one extension layer, the first encoded stream encoded by the first codec on the extension layer is delayed for the integer number of preset frames according to the preset information about the integer number of frames of delay, and in this case, processing is not performed for bit information in the stream, but the stream as a whole is delayed for a length of a transmission frame.

The method for presetting the information about the integer number of frames of delay is not necessarily performed after step S401. Because two steps are correlated with each other, this method maybe performed at other time to ensure that the first encoded stream is delayed for the integer number of preset frames according to the information about the integer number of frames of delay.

S403: Use the first codec to decode other encoded streams to obtain the first decoded signal, where the other encoded streams are obtained by the first codec encoding at other layers excluding the at least one extension layer.

The first codec decodes other encoded streams. For the other layers excluding the at least one extension layer, the encoding method and the encoding bandwidth before the transcoding are different from those after the transcoding, and encoding and then decoding is required. The first codec decodes the other encoded streams to obtain the first decoded signal. The first decoded signal is used for being provided for the second codec for performing the encoding operation in the transcoding method.

S404: Perform delay aligning and adjusting on the first decoded signal to obtain an adjusted signal.

The first decoded signal is obtained by the first codec decoding other encoded streams which include a core-layer encoded stream and exclude the first encoded stream, where the other encoded streams are obtained by the first codec encoding at other layers excluding the at least one extension layer. The relationship between the delay of the second encoded stream and the delay of the first encoded stream delayed for the integer number of frames corresponds to the relationship between the encoding delay of the second codec encoding at the at least one extension layer and the encoding delay of encoding at the other layers. The at least one extension layer is not encoded or decoded any more, but the first encoded stream encoded by the first codec is multiplexed directly. Therefore, the first time point of the other encoded streams needs to be aligned with the second time point of the at least one extension layer, or the mapping of the aforementioned delay relationship needs to be generated. Through S402 and the adjustment of the first time point and the second time point in this step, it is ensured that: The delay relationship between streams multiplexed and output for the second-time decoding corresponds to the delay relationship between the streams obtained by the second codec encoding at only at least one extension layer and the streams obtained by the second codec encoding at the other layers excluding the at least one extension layer.

S405. Use a second codec to encode the adjusted signal to obtain a second encoded stream.

In this way, after the second codec is used to encode the input signals, a first delay relationship exists between the encoded stream of the at least one extension layer and the encoded stream of other layers, and, after the integer number of frames of delay according to the embodiment of the present application is used, the delay relationship between the first encoded stream and the second encoded stream corresponds to the first delay relationship. Therefore, high encoding complexity is avoided for the multiplexing of the first stream and the second stream that is delayed for the integer number of frames, no other operation is added, and the universal stream multiplexing operation is applicable.

S406. Multiplex and output the second encoded stream and the first encoded stream that is delayed for the integer number of frames.

The multiplexed stream is provided for the second codec for decoding operation so that the original signals are restored.

In another embodiment of the present application, other manners may be adopted in the steps of presetting the information about the integer number of frames of delay and the adjustment delay information required for delay aligning and adjusting. In all the preceding embodiments, the information about the integer number of frames of delay and the adjustment delay information required for delay aligning and adjusting are determined in a presetting manner. That is, such information may be preset in the process of setting up or modularizing the system, and, in implementation process of the transcoding, the preset information is read, the first encoded stream is delayed for the integer number of frames, and the first decoded signal undergoes delay aligning and adjusting to obtain the adjusted signal. In this embodiment, the information about the integer number of frames of delay and the adjustment delay information required for delay aligning and adjusting may be determined in real time or in advance in the transcoding process according to the length of the signal frame, in combination with the delays of the encoded streams and decoded streams of the first codec and the second codec.

In another embodiment of the present application, the step of presetting the information about the integer number of frames of delay and the adjustment delay information required for delay aligning and adjusting may also be: presetting one of the two pieces of information, or determining one of the two pieces of information in the transcoding process according to the length of the signal frame and the delay of the encoded streams and decoded streams of the first codec and the second codec, and then configuring the other information according to the determined one of the two pieces of information, where the integer number of frames and the adjustment delay satisfy the following relationship: The adjustment delay relates to the integer number of frames according to the length of the signal frame in combination with the delays of the encoded streams and decoded streams of the first codec and the second codec.

Another embodiment of the present application provides a universal decoding method. When the first codec and the second codec need to be changed on specific occasions, according to the information about the integer number of frames of delay and the adjustment delay information required for delay aligning and adjusting, where the two pieces of information are determined by different codec parameters, the operations of delaying for the integer number of frames and delay aligning and adjusting are performed.

In another aspect, the present application is widely applicable in more scenarios, and the first codec and the second codec may be not only simple stand-alone codecs, but also sophisticated structures, for example, in a Partial Mixing application. Partial Mixing is an efficient audio mixing method in a conference system. It decodes and mixes traditional narrowband or wideband streams in multiple encoded signals, but selects only an extension-layer stream of a specific encoded signal as the extension-layer stream after mixing. When the receiver still needs transcoding, the advantages of Partial Mixing are wasted if the traditional transcoding method is used. By using the transcoding method provided in the embodiment of the present application, it is necessary only to perform delay aligning and adjusting on the mixed narrowband or wideband streams as (N-M)layer, and delay the extension-layer streams as Mlayer for the integer number of frames. This transcoding method still does not require decoding of the extension-layer streams, and improves the efficiency of transcoding, encoding and decoding.

In the transcoding method in the embodiment of the present application, only a part of streams are encoded and decoded again; the streams which are not decoded or encoded any more undergo delay aligning and adjusting, and the part of streams decoded and encoded again are delayed for the integer number of frames. In this way, the transcoding complexity of the embedded codec may be reduced significantly, and the quality of signals being transcoded is enhanced effectively because a part of streams are not encoded or decoded any more. A universal transcoding means is provided for transcoding between different codecs, and, for the transcoding between most embedded codecs, extra delay generated by the transcoding may be reduced, for example, no extra delay at the time of transcoding may be generated.

Embodiment 6

Figure 7:
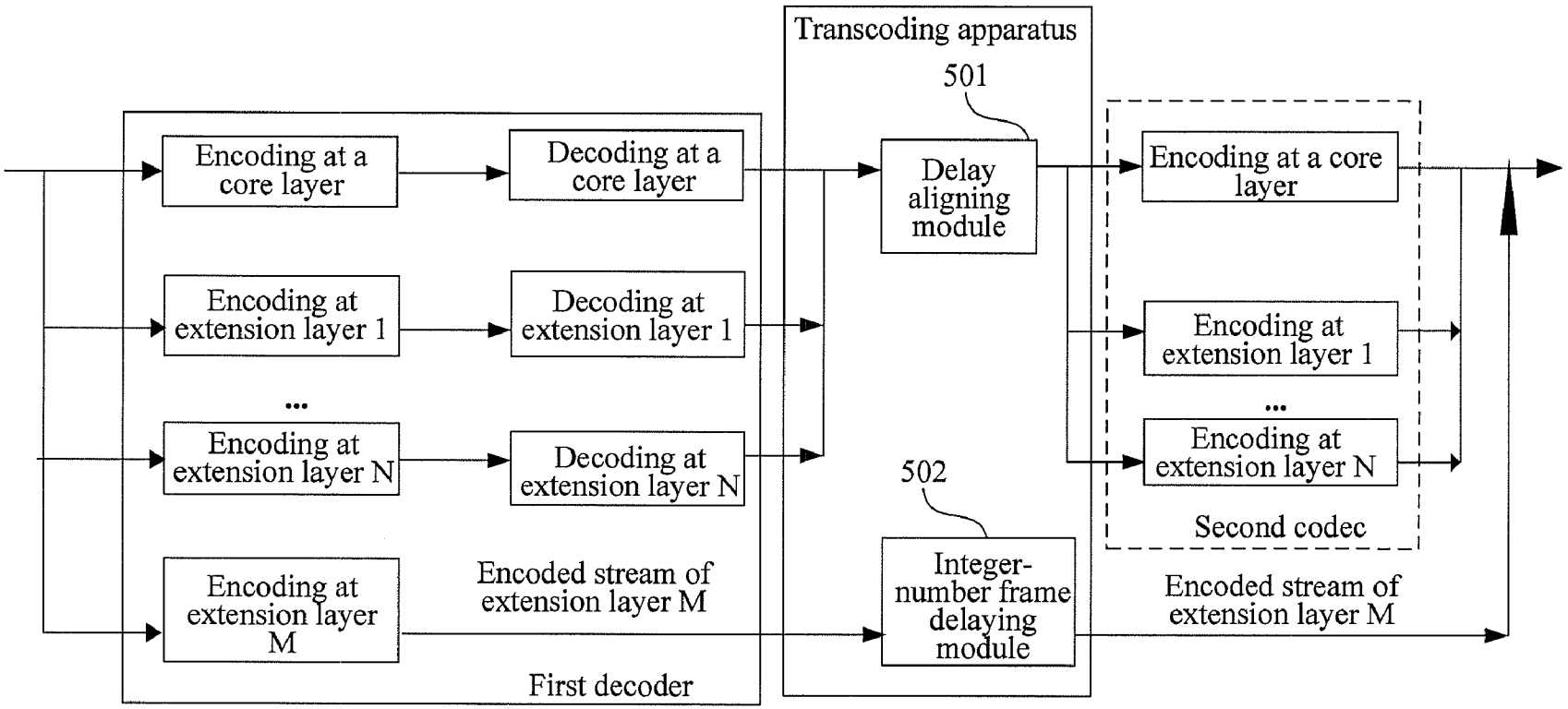
FIG. 7 is a schematic diagram of a transcoding apparatus embodiment according to the present application.

An embodiment of the present application provides a transcoding apparatus for transcoding between two embedded codecs. As shown in FIG. 7, the transcoding apparatus includes:

an integer-number frame delaying module 501, configured to delay a first encoded stream in input streams for an integer number of frames, where the first encoded stream includes a stream of at least one extension layer in the input streams obtained after input signals are encoded by using a first codec; and a delay aligning module 502, configured to align and adjust delay of a first decoded signal to obtain an adjusted signal, where the first decoded signal is obtained by the first codec decoding other encoded streams in the input streams, the other encoded streams include streams of other layers in the input streams after the input signals are encoded by using the first codec, and the streams of other layers include a core-layer stream and exclude the first encoded stream.

The transcoding apparatus in this embodiment performs encoding and decoding again for only a part of streams; a delay aligning module is used to perform delay aligning and adjusting on the streams which are not decoded or encoded any more, and an integer-number frame delaying module is used to delay the part of streams decoded and encoded again for the integer number of frames. In this way, the transcoding complexity of the embedded codec may be reduced significantly, and the quality of signals being transcoded is enhanced effectively because a part of streams are not encoded or decoded anymore. For the transcoding between most embedded codecs, extra delay generated by the transcoding may be reduced, for example, no extra delay at the time of transcoding may be generated.

Embodiment 7

Figure 8:
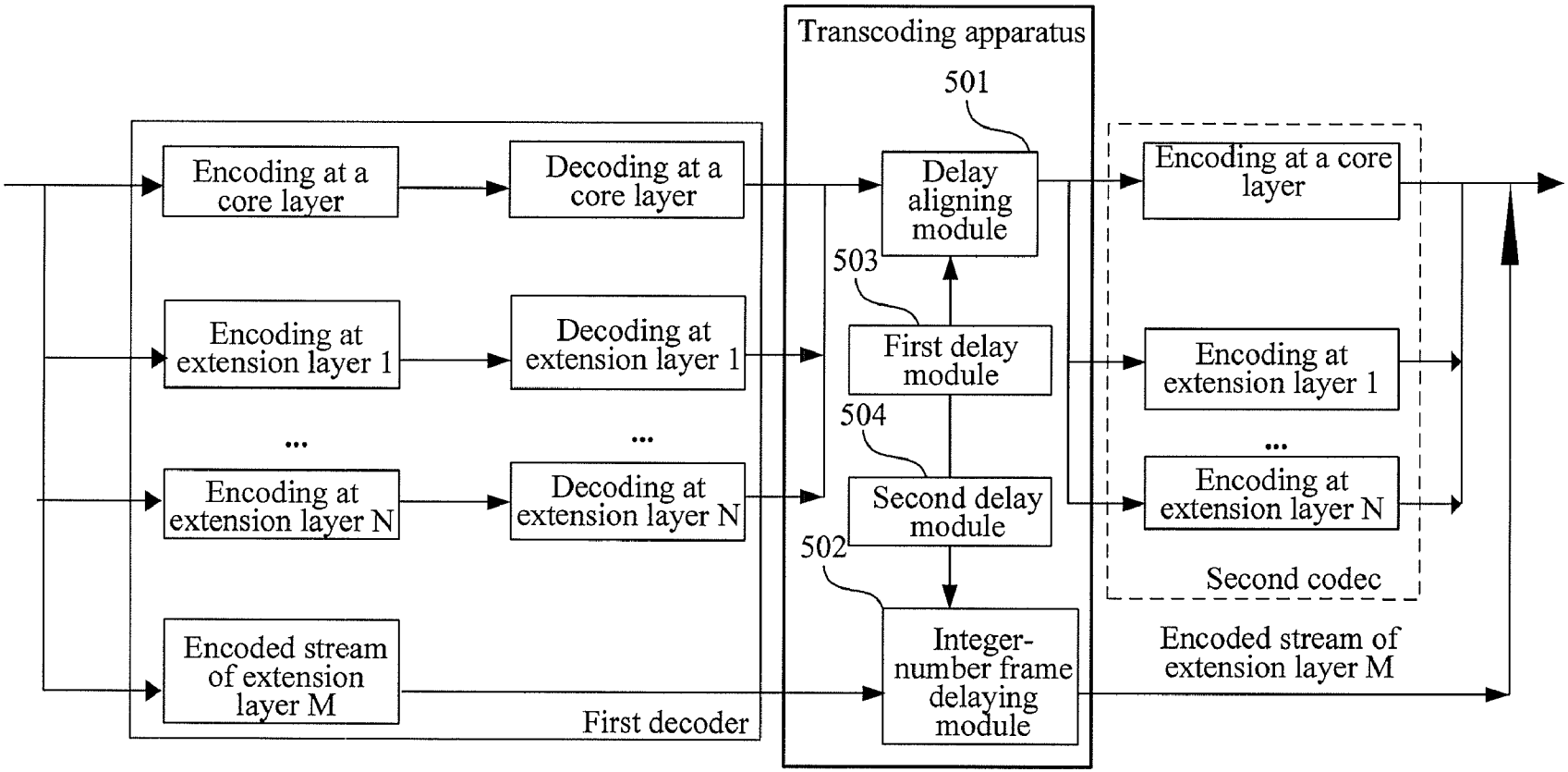
FIG. 8 is a schematic diagram of another transcoding apparatus embodiment according to the present application.

Another embodiment of the present application provides a transcoding apparatus, as shown in FIG. 8, for transcoding between two embedded codecs, including:

An integer-number frame delaying module 501 is configured to delay the first encoded stream for an integer number of frames.

The first encoded stream is obtained by the first codec encoding the at least one extension layer, and the integer-number frame delaying module 501 delays the first encoded stream for the preset integer number of frames according to the information about the integer number of frames of delay.

The delay aligning module 502 is configured to perform delay aligning and adjusting on the first decoded signal to obtain an adjusted signal.

The first decoded signal is obtained by the first codec decoding other encoded streams which include a core-layer encoded streams exclude the first encoded stream, where the other encoded streams are obtained by the first codec encoding at other layers excluding the at least one extension layer. The delay aligning module 502 performs delay aligning and adjusting on the first decoded signal according to the adjustment delay information required for delay aligning and adjusting.

The apparatus further includes a first delay module 503, configured to determine information about the integer number of frames of delay.

The first delay module 503 determines the integer number of frames of delaying the first encoded stream, according to the length of the signal frame and in combination with the delay of encoded streams and decoded streams of the first codec and the second codec.

A second delay module 504 is configured to determine the adjustment delay of performing delay aligning and adjusting on the decoded signal.

The adjustment delay of performing delay aligning and adjusting on the decoded signal is determined according to the length of the signal frame, in combination with the delay of encoded streams and decoded streams of the first codec and the second codec, and the integer number of frames of delaying the first encoded stream.

The first delay module and the second delay module above may be embedded into a system as parameter presetting modules at the time of setting up the system; and the data determined by such modules is directly invoked when the first encoded stream is delayed for the integer number of preset frames and the first decoded signal undergoes delay aligning and adjusting to obtain the adjusted signal.

The first delay module and the second delay module above may also be invoked when the integer-number frame delaying module 501 delays the first encoded stream for the integer number of frames, and when the delay aligning module 502 aligns and adjusts the first decoded signal, in the running process of the transcoding apparatus.

The first delay module and the second delay module may be physically separated entities or entities independent of each other. That is, their physical location may be independent of the integer-number frame delaying module and the delay aligning module. As shown in FIG. 8, the first delay module may also be set in the integer-number frame delaying module, and the second delay module may be set in the delay aligning module.

The method and the bandwidth for the first codec encoding at the at least one extension layer are the same as those for the second codec encoding at the at least one extension layer. The relationship between the delay of the second encoded stream and the delay of the first encoded stream delayed for the integer number of frames corresponds to the relationship between the encoding delay of the second codec encoding at the at least one extension layer and the encoding delay of encoding at other layers.

The transcoding apparatus in this embodiment performs encoding and decoding again for only a part of streams; a delay aligning module is used to perform delay aligning and adjusting on the streams which are not decoded or encoded any more, and an integer-number frame delaying module is used to delay the part of streams decoded and encoded again for the integer number of frames. In this way, the transcoding complexity of the embedded codec may be reduced significantly, and the quality of signals being transcoded is enhanced effectively because a part of streams are not encoded or decoded anymore. For the transcoding between most embedded codecs, extra delay generated by the transcoding may be reduced, for example, no extra delay at the time of transcoding may be generated.

Embodiment 8

Figure 9:
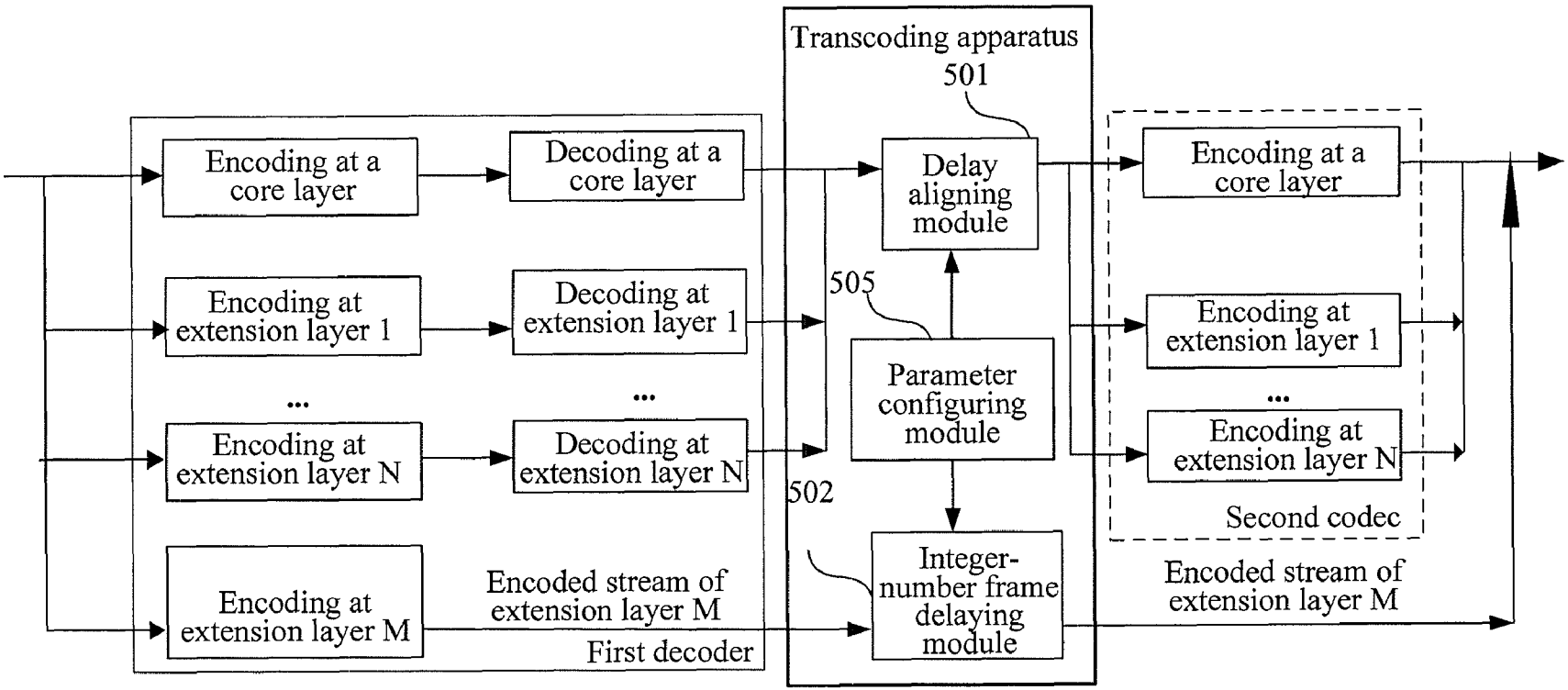
FIG. 9 is a schematic diagram of a transcoding apparatus embodiment according to the present application.

Another embodiment of the present application provides a transcoding apparatus, as shown in FIG. 9, for transcoding between two embedded codecs like embodiment 7, including:

an integer-number frame delaying module 501, configured to delay the first encoded stream for the integer number of frames; and a delay aligning module 502, configured to perform delay aligning and adjusting on the first decoded signal to obtain an adjusted signal.

The apparatus further includes a parameter configuring module 505, which is configured to set the integer number of frames for delaying the first encoded stream and/or set the adjustment delay according to the first codec and the second codec, where the integer number of frames and the adjustment delay satisfy the following relationship:

The adjustment delay relates to the integer number of frames according to the length of the signal frame, in combination with the delay of the encoded streams and decoded streams of the first codec and the second codec. That is, the adjustment delay (the integer number of frames of delaying the first encoded stream) is obtained according to the foregoing relationship by configuring the integer number of frames (adjustment delay) of delaying the first encoded stream.

The method and the bandwidth for encoding at the at least one extension layer are consistent with those for the second codec encoding at the at least one extension layer. The relationship between the delay of the second encoded stream and the delay of the first encoded stream delayed for the integer number of frames corresponds to the relationship between the encoding delay of the second codec encoding at the at least one extension layer and the encoding delay of encoding at other layers.

In another embodiment of the present application, the parameter configuring module may be included together with the first delay module and the second delay module in the transcoding apparatus. The parameter configuring apparatus provides the parameter information required by the first delay module and the second delay module; or the parameter configuring module determines the information about the integer number of frames of delay of the first delay module, and provides the information for the second delay module, or vice versa. The interoperation between the parameter configuring module and the first delay module and the second delay module may be determined according to the implementation environment, and is not limited to thereto.

The transcoding apparatus in this embodiment performs encoding and decoding again on only a part of streams; a delay aligning module is used to perform delay aligning and adjusting on the streams which are not decoded or encoded any more, and an integer-number frame delaying module is used to delay the part of streams decoded and encoded again for the integer number of frames. In this way, the transcoding complexity of the embedded codec may be reduced significantly, and the quality of signals being transcoded is enhanced effectively because a part of streams are not encoded or decoded any more. A universal transcoding means is provided for transcoding between different codecs, and, for the transcoding between most embedded codecs, extra delay generated by the transcoding may be reduced, for example, no extra delay at the time of transcoding may be generated.

Embodiment 9

Figure 10:
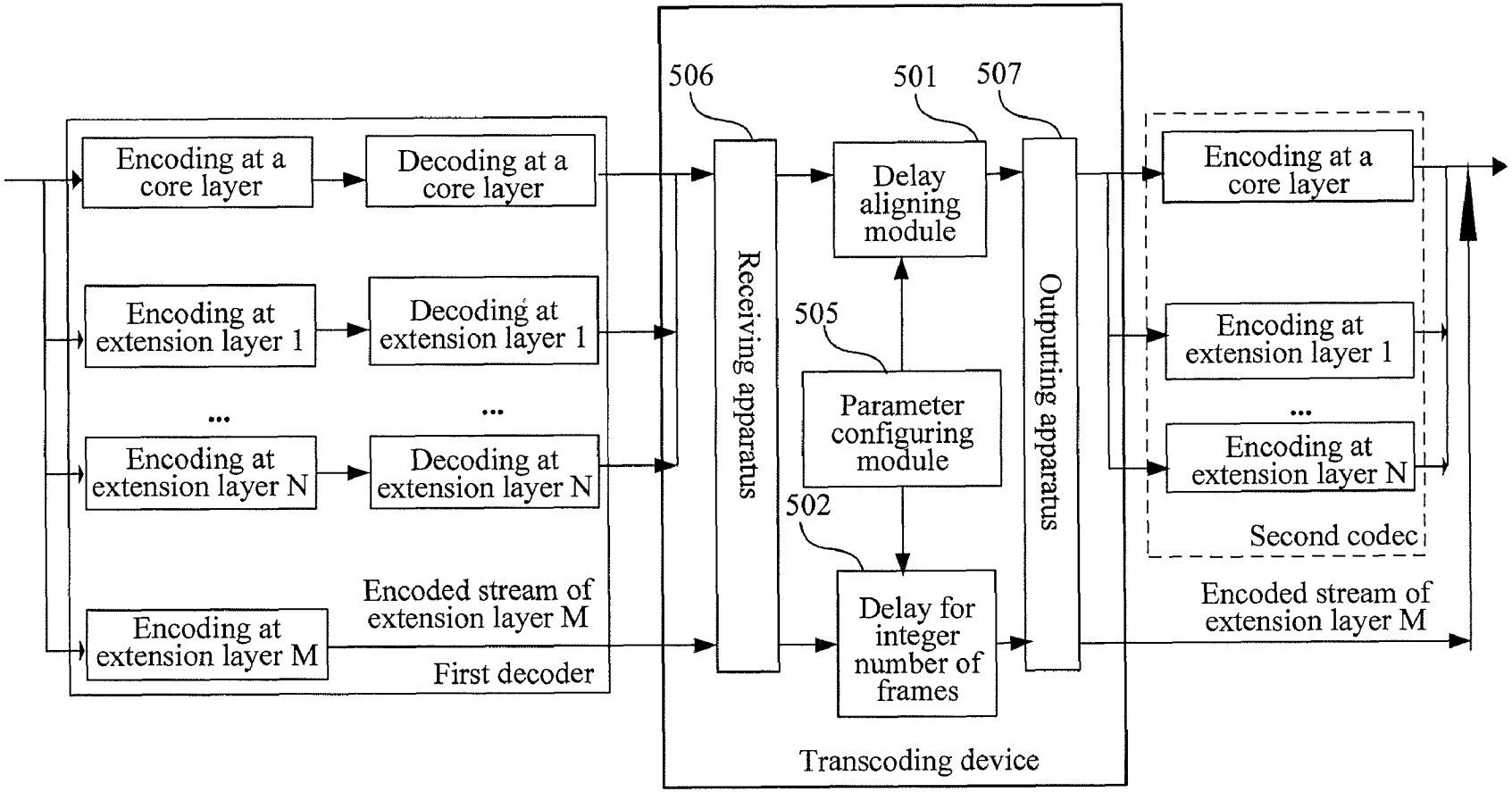
FIG. 10 is a schematic diagram of a transcoding device embodiment according to the present application.

An embodiment of the present application provides a transcoding device, as shown in FIG. 10, where the transcoding device implements transcoding between two embedded codecs. The modules of the transcoding device are configured to receive encoded and decoded signals which are output by the first codec and to be processed, perform transcoding on the received signals, and provide the processed signals to the second codec for decoding. The transcoding device includes:

a receiving apparatus 506, configured to receive a first encoded stream in input streams and a first decoded signal which is obtained by the first codec decoding other encoded streams in the input streams except the first encoded stream, where the first encoded stream includes a stream of at least one extension layer in the input streams after the input signals is decoded by using the first codec;

an integer-number frame delaying module 501, configured to delay the first encoded stream for an integer number of frames;

a delay aligning module 502, configured to perform delay aligning and adjusting on the first decoded signal to obtain an adjusted signal, where the other encoded streams include streams of other layers in the input streams after the input signals are encoded by using the first codec, and the streams of other layers include a core-layer stream and exclude the first encoded stream; and an outputting apparatus 507, configured to output to a second codec the adjusted signal and the first encoded stream that is delayed for the integer number of frames.

The integer-number frame delaying module and the delay aligning module are the same as the integer-number frame delaying module and the delay aligning module in the preceding embodiments of the transcoding apparatus.

The method and the bandwidth for the first codec encoding at the at least one extension layer are the same as those for the second codec encoding at the at least one extension layer. The relationship between the delay of the second encoded stream obtained by the second codec encoding the adjusted signal and the delay of the first encoded stream delayed for the integer number of frames corresponds to the relationship between the encoding delay of the second codec encoding at the at least one extension layer and the encoding delay of encoding at other layers.

In another transcoding device embodiment of the present application, the device further includes other modules described in the preceding transcoding apparatus embodiments, as shown in FIG. 10.

The transcoding device in this embodiment performs encoding and decoding again on only a part of streams; a delay aligning module is used to perform delay aligning and adjusting on the streams which are not decoded or encoded any more, and an integer-number frame delaying module is used to delay the part of streams decoded and encoded again for the integer number of frames. In this way, the transcoding complexity of the embedded codec may be reduced significantly, and the quality of signals being transcoded is enhanced effectively because a part of streams are not encoded or decoded any more. A universal transcoding means is provided for transcoding between different codecs, and, for the transcoding between most embedded codecs, extra delay generated by the transcoding may be reduced, for example, no extra delay at the time of transcoding may be generated.

Embodiment 10

Figure 11:
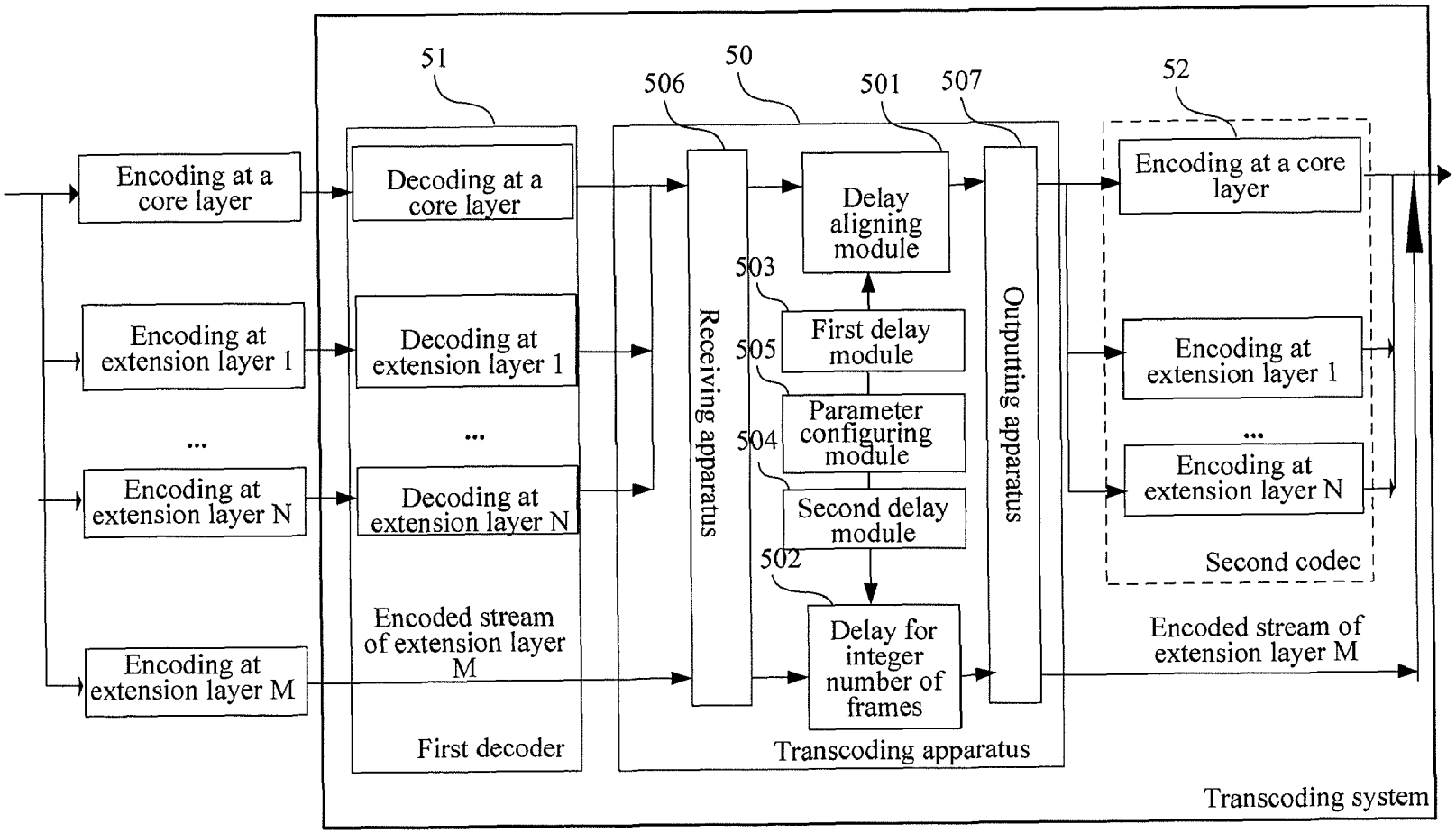
FIG. 11 is a schematic diagram of a transcoding system embodiment according to the present application.

An embodiment of the present application provides a transcoding system. As shown in FIG. 11, the transcoding system includes a first codec 508, a transcoding apparatus 50, and a second codec 509.

The first codec implements a decoding function and is configured to decode other encoded streams to obtain a first decoded signal, where the other encoded streams include streams of other layers in input streams obtained after input signals is encoded by using the first codec, and the streams of other layers include a core-layer stream and exclude a first encoded stream; the transcoding apparatus is configured to delay the first encoded stream for an integer number of frames, and perform delay aligning and adjusting on the first decoded signal to obtain an adjusted signal; and the second codec implements an encoding function and is configured to encode the adjusted signal to obtain a second encoded stream, and multiplex the second encoded stream and the first encoded stream that is delayed for the integer number of frames.

The first codec can also encode input signals to obtain the first encoded stream corresponding to the at least one extension layer and other encoded streams that include a core-layer encoded stream. The method and the bandwidth for the first codec encoding at the at least one extension layer are consistent with those for the second codec encoding at the at least one extension layer. The second codec may also decode the second encoded stream and the stream after the first encoded stream delayed for the integer number of frames is multiplexed.

The first codec encodes the input signals to obtain the first encoded stream corresponding to the at least one extension layer and other encoded streams that include a core-layer encoded stream. The first codec decodes other encoded streams to obtain the first decoded signal, where the other encoded streams obtained by the first codec encoding at other layers excluding the at least one extension layer. The transcoding apparatus receives the first encoded stream, obtains the information about the integer number of frames of delay, and delays the first encoded stream for the integer number of frames according to the information about the integer number of frames of delay; the transcoding apparatus receives the first decoded stream, obtains the adjustment delay information required for delay aligning and adjusting, and perform delay aligning and adjusting on the first decoded signal according to the adjustment delay information to obtain an adjusted signal; and the transcoding apparatus outputs the first encoded stream delayed for the integer number of frames and the adjusted signal. As described in the preceding embodiments of transcoding apparatuses or transcoding devices, the relationship between the delay of the second encoded stream and the delay of the first encoded stream delayed for the integer number of frames corresponds to the relationship between the encoding delay of the second codec encoding at the at least one extension layer and the encoding delay of encoding at other layers. The second codec encodes the adjusted signal to obtain a second encoded stream, and decodes the second encoded stream and the stream after the first encoded stream delayed for the integer number of frames is multiplexed.

In the transcoding system in this embodiment, only a part of streams are encoded and decoded again; the transcoding apparatus is used to perform delay aligning and adjusting on the streams which are not decoded or encoded any more, and the part of streams decoded and encoded again are delayed for the integer number of frames. In this way, the transcoding complexity of the embedded codec may be reduced significantly, and the quality of signals being transcoded is enhanced effectively because a part of streams are not encoded or decoded any more. A universal transcoding means is provided for transcoding between different codecs, and, for the transcoding between most embedded codecs, extra delay generated by the transcoding maybe reduced, for example, no extra delay at the time of transcoding may be generated.

Another embodiment of the present application provides a mobile station that includes the transcoding apparatus in the preceding embodiment, and provides a network element that also includes the transcoding apparatus in the preceding embodiment. The transcoding apparatus provides the transcoding operation in the mobile station and the network element. The transcoding apparatus is not limited to being in the mobile station or the network element, and any communication device or system that requires the transcoding operation may employ the foregoing transcoding apparatus and transcoding method and is not limited thereto.

The foregoing embodiments of the present application are applicable to voice signals or even other data signals with properties of a signal processed by embedded codecs. Persons of ordinary skill in the art should understand that all or part of the steps of the method provided in the embodiments above may be implemented by a program instructing relevant hardware. The program may be stored in computer readable storage medium. When the program runs, the procedures of the methods in the preceding embodiments may be included. The storage medium may be a magnetic disk, compact disk, read-only memory (Read-Only Memory, ROM), or random access memory (Random Access Memory, RAM).

Finally, it should be noted that the above embodiments are merely used for illustrating the technical solutions of the present application, but not intended to limit the present application. Although the embodiments of the present application is illustrated in detail with reference to the exemplary embodiments, persons skilled in the art should understand that: they still can make modifications and equivalent replacements to the technical solutions of the present application, but these modifications and equivalent replacements does not make the modified solutions depart from the spirit and scope of the application.

What is claimed is:

1. A transcoding method for transcoding between two embedded codecs, the method comprising:

delaying a first encoded stream in input streams for an integer number of frames, the first encoded stream comprises a stream of at least one extension layer in the input streams obtained after input voice signals are encoded by using a first codec;

performing delay aligning and adjusting on a first decoded signal to obtain an adjusted signal, the first decoded signal is obtained by the first codec decoding other encoded streams in the input streams, the other encoded streams comprise streams of other layers in the input streams obtained after the input voice signals are encoded by using the first codec, and the streams of other layers comprise a core-layer stream and exclude the first encoded stream;

wherein a method and a bandwidth used by the first codec for encoding the at least one extension layer are the same as those used by a second codec for encoding the at least one extension layer; and wherein a relationship between a delay of a second encoded stream obtained by a second codec encoding the adjusted signal and a delay of the first encoded stream delayed for the integer number of frames corresponds to a relationship between an encoding delay of the second codec encoding the at least one extension layer and an encoding delay of encoding at other layers.

2. The method according to claim 1, wherein:

the integer number of frames of delaying the first encoded stream is determined according to length of a signal frame in combination with delays of encoded streams and decoded streams of the first codec and the second codec.

3. The method according to claim 2, wherein:

an adjustment delay for performing delay aligning and adjusting on the first decoded signal is determined according to the length of the signal frame, in combination with the delay of encoded streams and decoded streams of the first codec and the second codec, and the integer number of frames for delaying the first encoded stream.

4. The method according to claim 2, wherein:

values of the integer number of frames for delaying the first encoded stream comprise a value determined by a ratio function of the frame length to a sum of differences between delays of encoded streams and decoded streams of the first codec and the second codec.

5. The method according to claim 4, wherein: an adjustment delay for performing delay aligning and adjusting on the first decoded signal comprises a calculation relationship between the integer number of frames related to the frame length and the sum of differences between delays of encoded streams and decoded streams of the first codec and the second codec.

6. A transcoding method, comprising:

delaying a first encoded stream in input streams for integer number of frames, wherein the first encoded stream comprises a stream of at least one extension layer in the input streams obtained after input voice signals are encoded by using a first codec;

using the first codec to decode other encoded streams in the input streams to obtain a first decoded signal, wherein the other encoded streams comprise streams of other layers in the input streams after the input voice signals are encoded by using the first codec, and the streams of other layers comprise a core-layer stream and exclude the first encoded stream;

performing delay aligning and adjusting on the first decoded signal to obtain an adjusted signal;

using a second codec to encode the adjusted signal to obtain a second encoded stream;

multiplexing and outputting the second encoded stream and the first encoded stream that is delayed for the integer number of frames;

wherein a method and a bandwidth for using the first codec for encoding the at least one extension layer are the same as those for using the second codec for encoding the at least one extension layer; and wherein a relationship between a delay of the second encoded stream and a delay of the first encoded stream delayed for the integer number of frames corresponds to a relationship between an encoding delay of encoding the at least one extension layer through the second codec and encoding delay of encoding at other layers.

7. The method according to claim 6, wherein:

the integer number of frames of delaying the first encoded stream is determined according to length of a signal frame and delays of encoded streams and decoded streams of the first codec and the second codec; and an adjustment delay for delay aligning and adjusting on the first decoded signal is determined according to the length of the signal frame, in combination with the delay of encoded streams and decoded streams of the first codec and the second codec, and the integer number of frames of delaying the first encoded stream.

8. A transcoding apparatus for transcoding between two embedded codecs, the apparatus comprising:

an integer-number frame delaying module delaying a first encoded stream in input streams for integer number of frames, wherein the first encoded stream comprises a stream of at least one extension layer in the input streams obtained after input voice signals are encoded by using a first codec;

a delay aligning module, configured to perform delay aligning and adjusting on a first decoded signal to obtain an adjusted signal, wherein the first decoded signal is obtained by the first codec decoding other encoded streams in the input streams, the other encoded streams comprise streams of other layers in the input streams after the input voice signals are encoded by using the first codec, and the streams of other layers comprise a core-layer stream and exclude the first encoded stream;

wherein a method and a bandwidth used by the first codec for encoding the at least one extension layer are the same as those used by the second codec for encoding the at least one extension layer; and wherein a relationship between a delay of the second encoded stream obtained by encoding the adjusted signal through the second codec and a delay of the first encoded stream delayed for the integer number of frames corresponds to a relationship between an encoding delay of the second codec encoding at the at least one extension layer and an encoding delay of encoding at other layers.

9. The apparatus according to claim 8, further comprising:

a first delay module, configured to determine the integer number of frames of delaying the first encoded stream according to length of a signal frame in combination with delays of encoded streams and decoded streams of the first codec and a second codec; and a second delay module, configured to determine adjustment delay for performing delay aligning and adjusting on the first decoded signal according to the length of the signal frame, in combination with the delays of encoded streams and decoded streams of the first codec and the second codec, and the integer number of frames for delaying the first encoded stream.

10. A transcoding device, comprising:

a receiving module, configured to receive a first encoded stream in input streams and a first decoded signal which is obtained by the first codec decoding other encoded streams in the input streams except the first encoded stream, wherein the first encoded stream comprises a stream of at least one extension layer in the input streams obtained after input voice signals is encoded by using the first codec;

an integer-number frame delaying module, configured to delay the first encoded stream for integer number of frames;

a delay aligning module, configured to perform delay aligning and adjusting on the first decoded signal to obtain an adjusted signal, wherein the other encoded streams comprise streams of other layers in the input streams after the input voice signals are encoded by using the first codec, and the streams of other layers comprise a core-layer stream and exclude the first encoded stream;

an outputting apparatus, configured to output to a second codec the adjusted signal and the first encoded stream that is delayed for the integer number of frames;

wherein a method and a bandwidth for the first codec encoding the at least one extension layer are the same as those for the second codec encoding the at least one extension layer; and wherein a relationship between a delay of the second encoded stream obtained by the second codec encoding the adjusted signal and a delay of the first encoded stream delayed for the integer number of frames corresponds to a relationship between an encoding delay of the second codec encoding the at least one extension layer and an encoding delay of encoding at other layers.

11. A transcoding system, comprising:

a first codec, configured to decode other encoded streams to obtain a first decoded signal, wherein the other encoded streams comprise streams of other layers in input streams obtained after input voice signals are encoded by using the first codec, and the streams of other layers comprise a core-layer stream and exclude a first encoded stream; the first encoded stream comprises a voice stream of at least one extension layer in the input streams obtained after input signals are encoded by using a first codec;

a transcoding apparatus, configured to delay the first encoded stream for an integer number of frames, and perform delay aligning and adjusting the first decoded signal to obtain an adjusted signal;

a second codec, configured to encode the adjusted signal to obtain a second encoded stream, and multiplex the second encoded stream and the first encoded stream that is delayed for the integer number of frames;

wherein a method and a bandwidth used by the first codec for encoding at the at least one extension layer are the same as those used by the second codec for encoding at the at least one extension layer; and wherein a relationship between a delay of the second encoded stream and a delay of the first encoded stream delayed for the integer number of frames corresponds to a relationship between encoding delay of the second codec encoding at the at least one extension layer and encoding delay of encoding at other layers.

* * * * *